United States Patent [19]

Kitadate et al.

[11] 4,418,421

[45] Nov. 29, 1983

[54] X-RAY APPARATUS

[75] Inventors: Kenichiro Kitadate, Higashimurayama; Yoshinori Tanimoto, Hachiouji, both of Japan

[73] Assignee: Tokyo Shibaura Denki Kabushiki Kaisha, Kawasaki, Japan

[21] Appl. No.: 329,057

[22] Filed: Dec. 9, 1981

[30] Foreign Application Priority Data

Jul. 20, 1981 [JP] Japan ..... 56-112109

[51] Int. Cl.[3] ..... H05G 1/06

[52] U.S. Cl. ..... 378/199; 378/200

[58] Field of Search ..... 378/199, 200, 201, 202, 378/101, 103, 105

[56] References Cited

U.S. PATENT DOCUMENTS

| | | | |
|---|---|---|---|
| 1,505,463 | 8/1924 | Holweck | 378/202 |
| 1,941,978 | 1/1934 | Fayer | 378/200 |
| 1,958,191 | 5/1934 | Fayer | 378/199 |
| 2,118,457 | 5/1938 | Bouwers | 378/201 |
| 2,216,210 | 10/1940 | Mutscheller | 378/199 |
| 2,909,664 | 10/1959 | Zunick et al. | 378/201 |

FOREIGN PATENT DOCUMENTS

| | | | |
|---|---|---|---|
| 1301864 | 8/1969 | Fed. Rep. of Germany | 378/101 |

*Primary Examiner*—Alfred E. Smith
*Assistant Examiner*—T. N. Grigsby
*Attorney, Agent, or Firm*—Finnegan, Henderson, Farabow, Garrett & Dunner

[57] ABSTRACT

A unitary portable X-ray apparatus including a high voltage section, an X-ray generator section and a cooled anode section. Preferably the sections are cylindrical and arranged end to end with at least the X-ray section being separated from the high voltage section by generally conically shaped bushings extending into the X-ray generator section. A cathode mounted in the extending end of the bushings and connected to a high voltage generator in the high voltage generator section contains a filament to which an AC voltage is applied by electromagnetic induction. A shielded anode mounted in the anode section and having a target therein has an open end extending into the X-ray section for axially aligning the target with the filament. Alternatively, the outer end sections may both be high voltage sections each separated from the X-ray generator section by generally conically shaped bushings extending into the X-ray generator section. In the latter embodiment, both the anode and the cathode are mounted in the X-ray generator section.

22 Claims, 7 Drawing Figures

X-RAY APPARATUS

BACKGROUND OF THE INVENTION

This invention relates to X-ray apparatus, and more particularly, to a compact, lightweight and portable X-ray apparatus.

The conditions for a portable X-ray apparatus require that the apparatus be relatively small, light and in an external form convenient for carrying.

Referring to FIG. 1, a conventional portable X-ray apparatus includes a cylindrical casing 14 containing an X-ray tube 10 and a high voltage transformer 11 and 12, the casing being filled with an insulating oil 13. The external form of the casing 14 is cylindrical for carrying, but the apparatus is very heavy due to the weight of the insulating oil 13.

To reduce this weight it is known to fill the casing 14 with sulfur hexafluoride (SF6) gas as a substitute for the insulating oil. However, the heat produced from the X-ray tube and the X-rays emitted from the X-ray tube themselves tend to lower the insulation ability of the SF6 gas, especially in high output X-ray apparatus. In another portable X-ray apparatus, shown in FIG. 2, an X-ray tube 20 is contained in a casing 23 which is filled with an insulating oil 21. A high voltage transformer 24, a rectifier 25, a protective resistor 26 and a filament transformer 27 compose a high voltage section 28. The components of the high voltage section 28 are contained in a casing 29 which is filled with an SF6 gas 30. These two casings 23 and 29 are connected to each other electrically and mechanically by bushings 31 and 31. The insulating oil is stored in a tank 32 and is introduced into the casing 23 by circulation pipes 33. Accordingly, the X-rays are not emitted in the region filled with the SF6 gas.

This apparatus is lighter than that shown in FIG. 1 and has a feature that the deterioration of the insulation ability of the SF6 gas is avoided. However, the apparatus shown in FIG. 2 is not always portable for the reason that the casings 23 and 29 are stacked one on the other and the tank 32 is connected to the casing 23. This apparatus, therefore, becomes heavier and more awkward to handle than the apparatus filled only with SF6 gas.

SUMMARY OF THE INVENTION

It is an object of this invention, therefore, to improve a compact, lightweight and portable X-ray apparatus.

The X-ray apparatus of the invention comprises an X-ray generator including a target in an anode opposite to a filament of a cathode, an X-ray generator casing containing the X-ray generator, the X-ray generator casing having a first bushing on which a first high voltage apply contact is provided and connected to the filament, a first high voltage generator casing having a bushing on which a high voltage supply contact is provided to connect with the high voltage apply contact, the second bushing being connected with the first bushing, a high voltage generator positioned in the high voltage generator casing and connected to the high voltage supply contact, means for applying an AC voltage to the filament, means for cooling the anode, and an outer container containing the X-ray generator casing, the high voltage generator casing, the AC voltage apply means and the cooling means coaxially.

DESCRIPTION OF THE PREFERRED EMBODIMENTS

Figure 1:
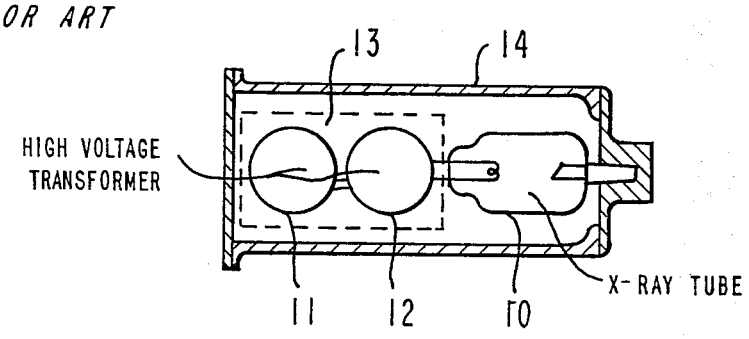
FIG. 1 PRIOR ART
FIGS. 1 and 2 are cross-sectional views of prior art X-ray apparatus.
Figure 2:
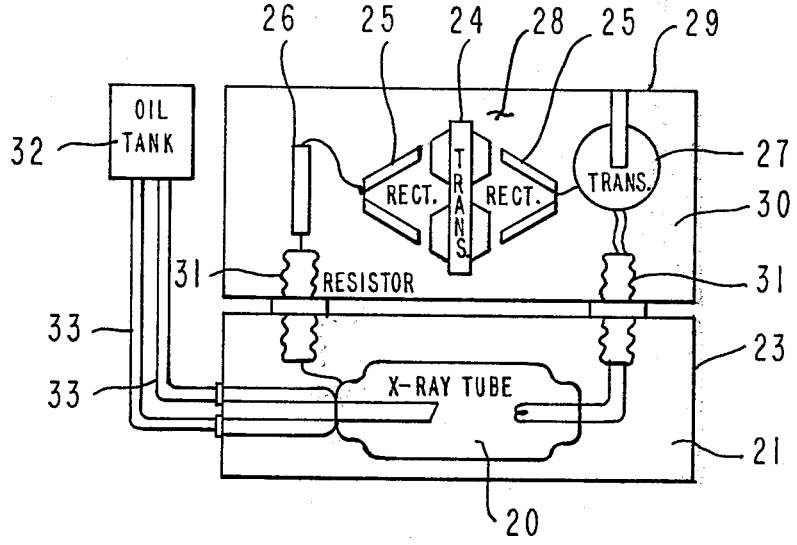
FIG. 2 PRIOR ART
Figure 3:
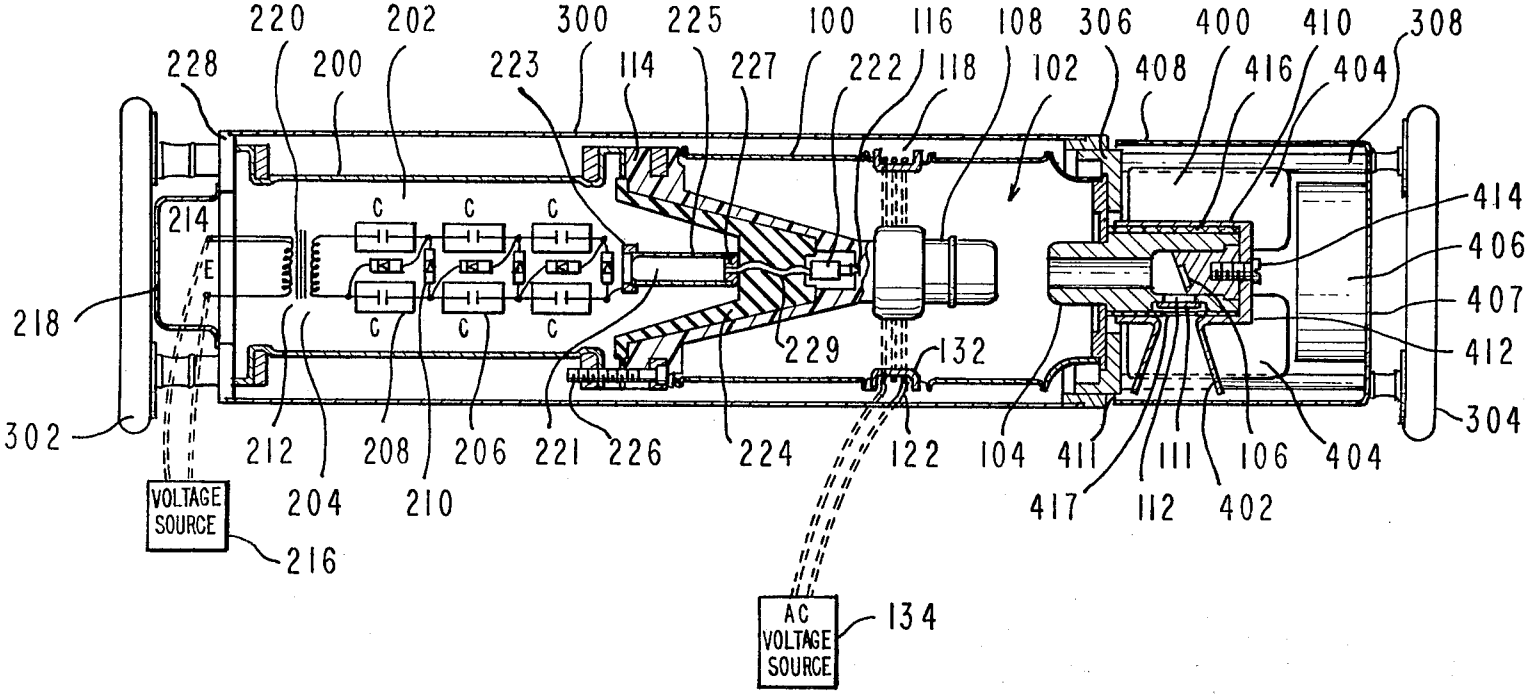
FIG. 3 is a cross-sectional view of an X-ray apparatus according to this invention.
Figure 4:
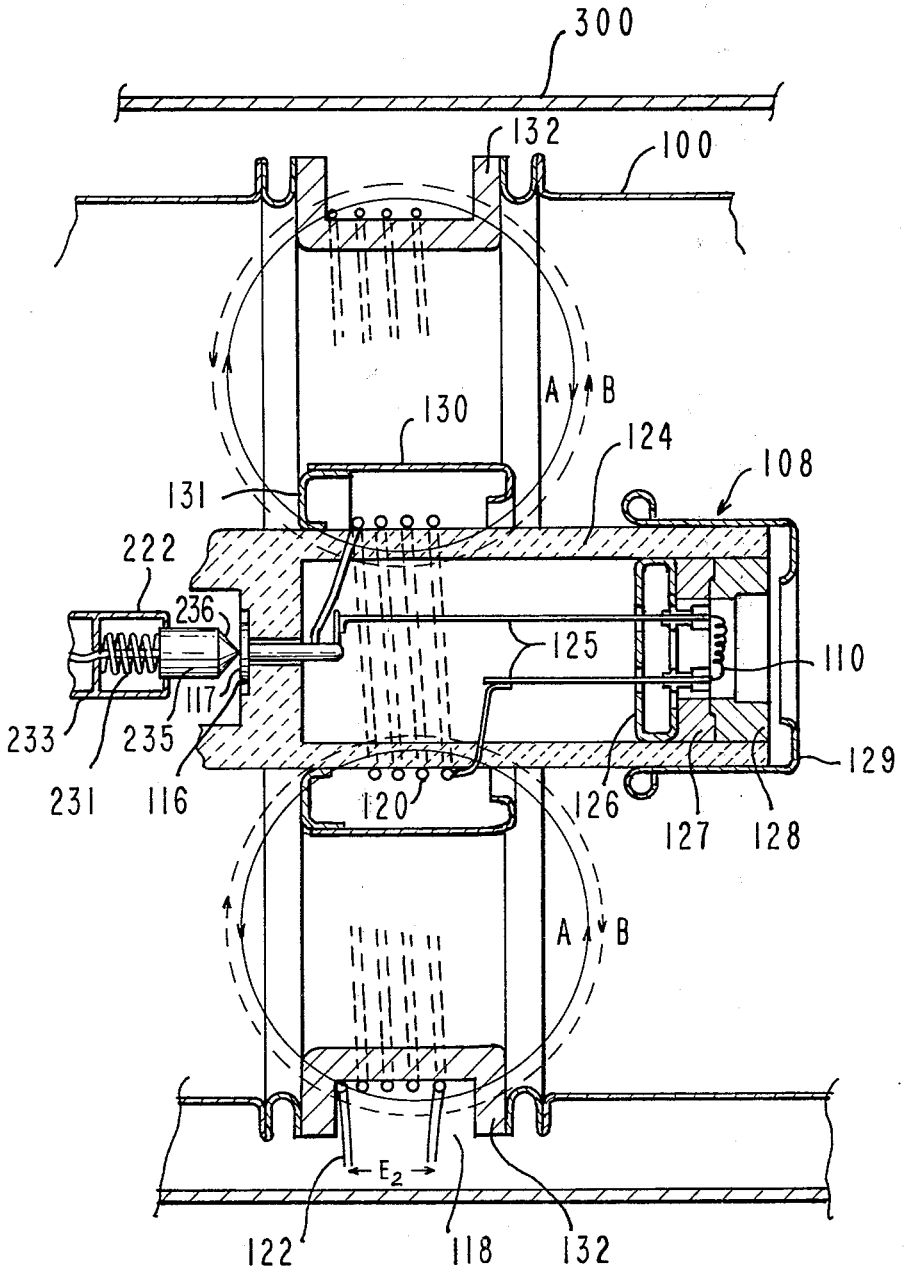
FIG. 4 is an enlarged cross-sectional view of a portion of the apparatus of FIG. 3.

Referring to FIGS. 3 and 4, this embodiment shows an anode grounding type X-ray apparatus in which an X-ray generator casing 100 and a high voltage generator casing 200 are connected to each other coaxially.

The X-ray generator casing 100 is, for example, cylindrical and includes an X-ray generator 102. A generally cylindrical cathode 108, including a filament 110, is positioned in the X-ray generator 102 and the open end of a cylindrical anode 104 projects into a space in which a vacuum is maintained around the generator 102. The cathode 108 and the anode 104 are axially aligned with the closed end of the anode extending away from the cathode 108 into an air-cooled section 400 to be described hereinafter.

A target 106 obliquely is positioned on inner surfaces of the closed end of the anode 104 and axially aligned with cathode 108, both being concentric with the axis of the generator casing 100. The anode 104 has, on a curved side thereof adjacent target 106, an X-ray emission outlet 112 which is closed by an X-ray transmission member 111, made, for example, of beryllium. The X-ray emission outlet 112 of the anode 104 is positioned in the closed end of the anode 104 so that the X-ray is emitted outwardly through the transmission member 111.

The cathode 108 is opposed to the anode 104 in the space 102 and is positioned at the end of the X-ray generator casing 100 next to the high voltage generator casing 200. This end of the X-ray generator casing is formed by a generally conical bushing 114, separating the section enclosed by the high voltage generator casing 100 from the X-ray generator 102. The bushing 114, which may be of epoxy resin, is recessed into the generator casing 100 for supporting the cathode 108, the longitudinal cross section of the bushing being substantially v-shaped and the lateral cross section being generally annular. At the center of the bushing 114, adjacent cathode 108 but on the side of the bushing opposite the cathode and having a portion extending through the bushing, a high voltage contact 116 is provided for applying a high voltage to the filament 110. The high voltage apply contact 116 is connected to the filament 110 through a secondary winding 120 of a generator 118 for applying an AC voltage to the filament.

The generator 118 for applying an AC voltage to the filament 110 comprises the secondary winding 120 and a primary winding 122 which induces an AC voltage in the secondary winding 120.

Referring particularly to FIG. 4, the secondary winding 120 is wound coaxially in the outer surface of a cylindrical support member 124 for supporting the filament 110. The support member 124 is made of non-magnetic material, such as ceramics. One end of the secondary winding 120 is connected to the high voltage apply contact 116 and to one terminal 125 of the filament 110, and the other end is connected to the other terminal 125 of the filament 110. That is, the secondary winding 120 and the filament 110 are connected both in series and in parallel.

Magnetic shield members 126, 127, 128 and 129 cover the back and sides of the filament 110 and also act as a cathode cap for collecting floating electrons from the filament. A cylindrical magnetic shield member 130 covers the outside of, but is spaced from, the secondary winding 120.

The magnetic shield members 126 to 130 are made of soft steel or permalloy and are kept at the same potential as the filament 110. The magnetic shield members 126, 127 and 128 are formed annularly and are secured to the support member 124 coaxially. The members 126 and 127 have openings through which the terminals 125 and 125 of the filament 110 are threaded. The cylindrical magnetic shield member 129 is secured to the outer end surface of the support member 124.

The magnetic shield member 130 is secured to an annular support ring 131 which is secured to the outer surface of the support member 124.

The primary winding 122, which induces the AC voltage in the secondary winding 120, is wound around an annular frame 132 which forms a portion of the cylindrical wall of the X-ray generator casing 100. The primary winding 122 is wound coaxially with the secondary winding 120 and is connected to an AC voltage source 134.

The high voltage generator casing 200 contains a high voltage generator 202 which is connected to the filament 110 for applying the high DC voltage thereto.

The high voltage generator casing 200 is formed as a cylinder and contains a high voltage transformer 204 and a well-known voltage doubler rectifier 206 composed of capacitors 208 and diodes 210. The transformer 204 and rectifier 206 are encapsulated in an epoxy resin within the casing 200. The primary winding 212 of the high voltage transformer 204 is introduced from the end of the high voltage generator casing 200 by voltage source terminals 214. The voltage source terminals 214 are connected to a voltage source 216. A terminal cover 218 is mounted on an end plate 228 of the high voltage generator casing 200.

The secondary winding 220 of the high voltage transformer 204 is connected to a high voltage supply contact 222 through the rectifier 206 and a metal lead 221. The lead 221 is composed of a ring 223, a cylindrical member 225 and an annular electrode 227. The ring 223 is electrically connected to the rectifier 206. The electrode 227 is secured to a bushing 224 which is concentric with, and complementary to, bushing 114. The bushing 224 may be made of synthetic rubber. The annular electrode 227 is connected to the high voltage supply contact 222 by a lead 229 threaded through the end of the bushing 224.

As shown in FIG. 4, the high voltage supply contact 222 is composed of a cylindrical member 233 and a contact member 235. The contact member 235 preferably has a conically shaped end 236 and is energized to bias the pointed end against a planar plate 117 of the high voltage apply contact 116 by a spring 231 which is contained in the cylindrical member 233. The high voltage supply contact 222 is positioned in an open area formed outside the pointed end of the bushing 224 and inside the pointed end of the bushing 114 of the X-ray generator casing 100, where the two bushings are nested together.

The lead 221, including the annular electrode 227, may also be encapsulated in exposy resin within the bushing 224, but the high voltage supply contact 222 is located between the pointed ends of the bushings 114 and 224 in an area which permits action of the spring 231 and the contact member 235 as described above.

As shown in FIG. 3, the bushing 224 of the high voltage generator casing 200 is fitted into the bushing 114 of the X-ray generator casing 100 and the casings 200 and 100 are connected to each other coaxially by a tie member 226.

Both of the casings 100 and 200 are contained in an outer container 300. Guard rings 302 and 304 for handling the container 300 are secured to the ends of the container 300. The guard ring 302 is secured to the end plate 228 of the high voltage generator casing 200. On the other hand, the guard ring 304 is secured to the container 300 by rods 308 through an anode cooler 400 for the closed end of the anode 104.

The anode cooler 400 contains an X-ray emission hood 402, cooling fins 404, a fan in a casing 406 and a cover 408. The X-ray emission hood 402 projects a radially outwardly from the X-ray emission outlet 112.

The cooling fins 404 are positioned radially at the outer face of the anode 104. The X-ray emission hood 402 and the cooling fins 404 are formed on a cylindrical boss 410 which is secured to the anode 104. An end portion 412 of the boss 410 in contact with the closed end portion of the anode 104 is secured thereto by a bolt 414. The X-ray emission hood 410 and the cooling fins 404 are arranged coaxially around the closed end of the anode 104.

The cover 408 and the guard ring 304 are secured by rods 308 which run through the cover 408 and are secured to a shoulder 306 of the container 300. There is a ventilation passageway 411 between an open end portion of the cover 408 and the shoulder 306 and the perforated planar end 407 of the cover 408 permits air-flow therethrough.

The fan and a motor (not shown) to drive the fan are enclosed in the casing 406 which is attached to the perforated planar end 407 of the cover 408 opposite the end plate 228 of the apparatus. Air flows through the perforated end 407 past the fins 404 and out through the ventilation passageway 411.

An X-ray shield member 416, made of lead, is formed cylindrically to cover the outer surface of the closed end of the anode 104. The shield member 416 is secured between the anode 104 and the boss 410. However, the shield member 416 has an opening 417 which is positioned at the X-ray emission outlet 112.

The operation of this embodiment will now be described.

At first, a supply voltage E1 from the voltage source 216 is applied to the high voltage transformer 204 and the voltage doubler rectifier 206 though the terminals 214 and a negative high DC voltage is produced at the high voltage supply contact 222. The negative high voltage is applied across the target 106 and the filament 110 through the high voltage apply contact 116. This embodiment is an anode grounding type and the target 106 is grounded, as known in the art.

On the other hand, for example, several ten volts of the AC voltage E2 from the AC voltage source 134 are applied to the primary winding 122 of the generator 118. Accordingly, an alternating magnetic field shown as a circular solid and dotted line in FIG. 4 is produced and, for example, six volts of an AC voltage are induced in the secondary winding 120. Consequently, a thermion is produced at filament 110. A secondary electron collides with the target 106 and the X-rays are emitted from the target 106. The X-rays are radiated, for example, to a test piece through the X-ray emission outlet 112.

Since this embodiment is the anode grounding type, the anode 104 is projected outwardly from the X-ray generator casing 100 and is cooled directly by the anode cooler 400.

Figure 5:
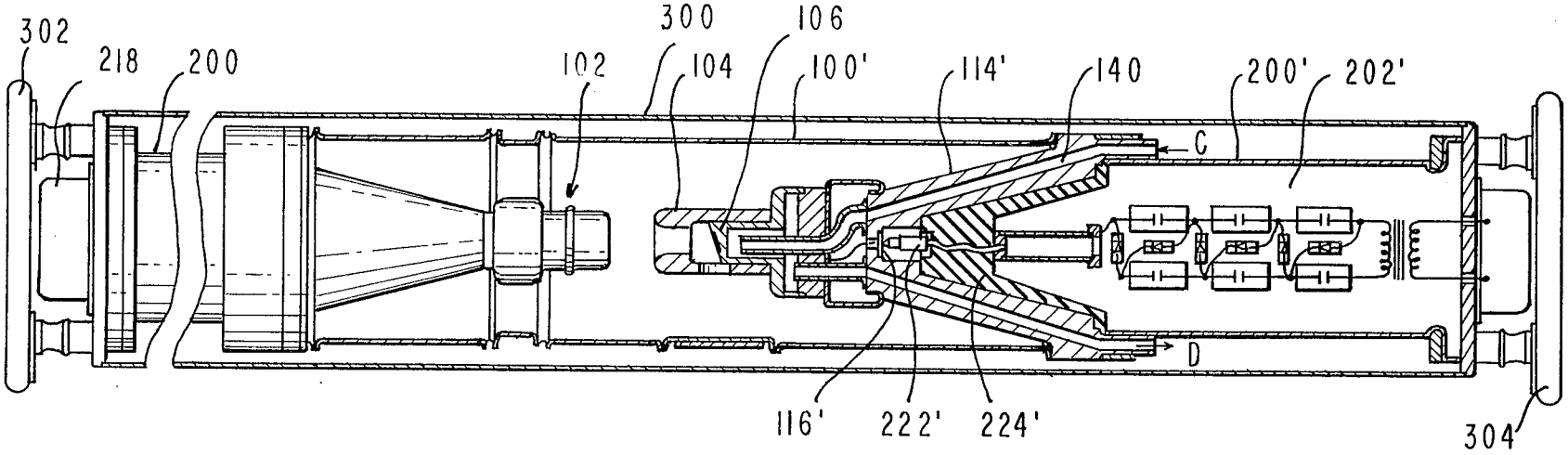
FIG. 5 is a cross-sectional view of another embodiment according to this invention.

On the other hand, the neutral grounding type has another anode high voltage generator casing 200' (in FIG. 5). In this embodiment, there is a cooling pipe 140 for circulating an oil between the X-ray generator casing 100 and the anode high voltage generator casing 200', as explained hereinafter.

In this second embodiment, a bushing 114' and a high voltage apply contact 116', like the bushing 114 and the high voltage apply contact 116 of the X-ray generator casing 100 of FIG. 3, are provided at the anode side of an X-ray generator casing 100'. The cooling pipe 140 is provided in the bushing 114' of the anode 104. The pipe 140 is formed in the bushing 114' along the inclination of the bushing, passes behind the target, and opens at the other end of the bushing. As shown in FIG. 5, the cooling oil is circulated along the arrows C and D.

The high voltage generator casing 200', in which a high voltage generator 202' is molded with resin, has a bushing 224' and a high voltage supply contact 222'. The high voltage generator 202' generates a a high voltage of which the polarity is reversed in comparison with the polarity of the high voltage generator 202. Bushing 224' of the high voltage generator casing 200' and the bushing 114' of the X-ray generator casing 100' are connected to each other and are connected with the high voltage generator casing 200 coaxially.

Figure 6:
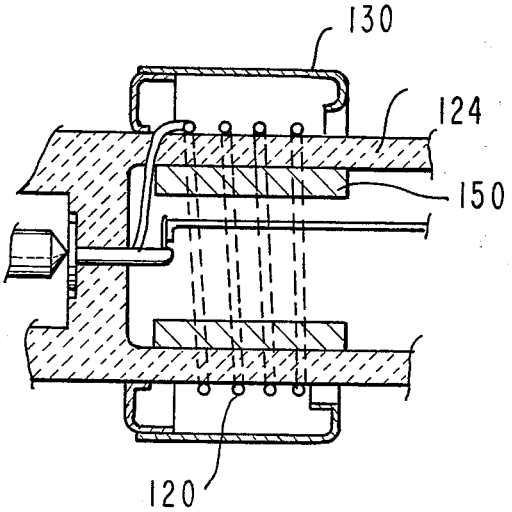
FIGS. 6 and 7 are cross-sectional views of relevant portions of further embodiments of the invention.

In the first embodiment, the generator 118 does not have a core. However, a core 150 for concentrating the magnetic field may be provided at the inner surface of the support member 125 shown in FIG. 6.

In the first and second embodiments, as shown, the bushings 114, 114' and 224, 224' have substantially a V-shaped longitudinal cross section. However, the bushings may be in any convenient shape, with the high voltage apply contact and the high voltage supply contact appropriately arranged.

Figure 7:
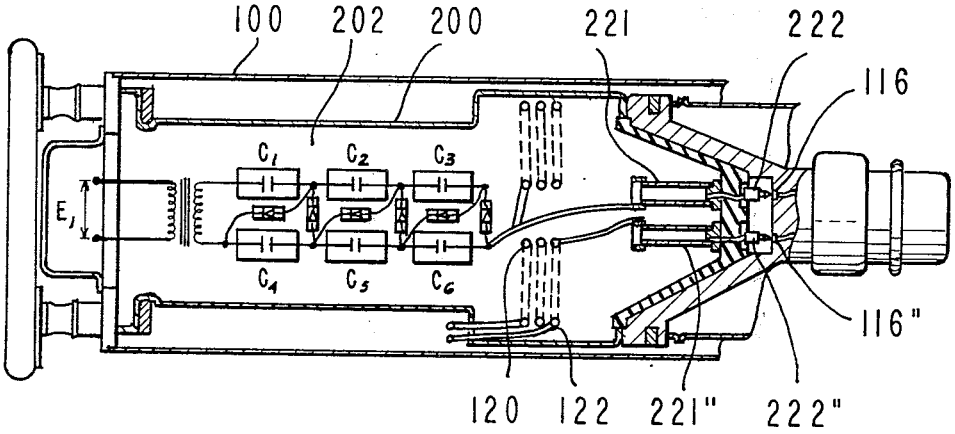

In the first and second embodiments, as shown, the generator 118 is positioned in the X-ray generator casing 100. The generator 118, however, may be positioned in the high voltage generator casing 200 as shown in FIG. 7. In such an arrangement, the primary winding 122 and the secondary winding 120 are positioned coaxially in the high voltage generator casing 200 and are molded with the high voltage generator 202 by a resin. The windings 122 and 120 are insulated from each other by the resin. One end of the secondary winding 120 is connected to one end of the filament through the lead 221, the supply contact 222 and the apply contact 116. The other end of the secondary winding 120 is similarly connected to the other end of the filament through the lead 221'', the supply contact 222'' and the apply contact 116''.

In the first embodiment, the high voltage transformer 204 is contained in the high voltage generator casing 200. The high voltage transformer 204, however, may be positioned out of the casing 200.

In the first embodiment, as shown, the shape of the outer container 300 is a right circular cylinder. However, the cross section of the container 300 may be square or any other shape convenient for ease of handling.

According to this invention, an AC voltage is applied to the filament by electro-magnetic induction so that the filament transformer 27 of the prior art can be avoided, eliminating not only the magnetic core but also the insulating oil. The X-ray generator and the high voltage generator are separately contained in their casings. The bushings provided on the casings are connected to each other coaxially. The high voltage generator is encapsulated in resin in its casing. Accordingly, the X-ray apparatus can be made compact, lightweight and portable.

What is claimed is:

1. An X-ray apparatus arranged as a single portable unit, said apparatus comprising:

an X-ray generator section, a high voltage generator section, a cooled section including means for cooling, each of said sections being enclosed in an individual casing;

bushing means for separating said X-ray generator section from said high voltage generator section in said unit;

a cathode centrally mounted on said bushing means in said X-ray generator section, said cathode including a cathode filament;

an anode having a target positioned in said cooled section, said anode having a portion extending into said X-ray generator section and aligning said target with said filament, said cathode filament and said anode target comprising an X-ray generator;

a high voltage generator mounted in said high voltage generator section;

means for applying power to said high voltage generator;

high voltage contact means mounted on said bushing means;

means for electrically connecting said contact means with said high voltage generator and said filament; and means for applying an AC voltage to said filament, said applying means including a secondary winding connected to said filament and a primary winding around, and spaced from, said secondary winding, both said windings being located in and coaxial with said X-ray generator section casing.

2. The X-ray apparatus of claim 1 wherein said anode is the grounding type.

3. The X-ray apparatus of claim 1 wherein said means for cooling includes fins mounted on said anode and means for forcing air from outside said apparatus across the surface of said fins.

4. The X-ray apparatus of claim 1 wherein said AC voltage applying means is encapsulated in said high voltage generator section with a resin.

5. The X-ray apparatus of claim 1 wherein said cathode further comprising:

a cylindrical support member for supporting said filament toward an open end of said cylindrical member, said secondary winding of said AC voltage applying means being wound on said support member; and a cylindrical cap mounted on said support member for shielding said filament and for collecting floating electrons from said filament.

6. The X-ray apparatus of claim 5 wherein said support member is made of a non-magnetic material.

7. The X-ray apparatus of claim 1 wherein bushing means comprises:

a first bushing forming an end wall of said X-ray generator section, said first bushing having a substantially V-shaped longitudinal cross section and being recessed inwardly; and a second bushing forming an end wall of said high voltage generator section, said second bushing having a substantially V-shaped longitudinal cross section and extending outwardly for insertion into said first bushing.

8. The X-ray apparatus of claim 7 wherein at least one of said first and second bushings is made of a synthetic rubber.

9. The X-ray apparatus of claim 7 wherein said high voltage generator includes:

a high voltage transformer having a primary winding and a secondary winding; and a rectifier interposed between said secondary winding and said high voltage contact means.

10. The X-ray apparatus of claim 9 wherein said high voltage generator is encapsulated in said high voltage section with an epoxy resin.

11. The X-ray apparatus of claim 9 wherein said high voltage contact means comprises an apply contact connected to said filament and a supply contact connected to said rectifier, said supply contact being biased against said apply contact.

12. The X-ray apparatus of claim 11 wherein said apply contact includes a plate and said supply contact includes a point biased against said plate.

13. The X-ray apparatus of claim 12 wherein said apply contact and said supply contact are positioned in a space between said first and second bushings.

14. An X-ray apparatus arranged as a single portable unit, said apparatus comprising:

an X-ray generator section;

first and second high voltage generator sections arranged one at each end of said X-ray generator section;

bushing means for separating said X-ray generator section from said first and second high voltage generator sections in said unit;

a cathode centrally mounted on said bushing means in said X-ray generator section, said cathode including a cathode filament;

an anode having a target positioned in said X-ray generator section, said anode having a portion extending into said X-ray generator section and aligning said target with said filament, said cathode filament and said anode target comprising an X-ray generator;

first and second high voltage generators mounted in said first and second high voltage generator sections, respectively;

means for applying power to said first and second voltage generators;

high voltage contact means mounted on said bushing means;

means for electrically connecting said contact means between said first high voltage generator and said filament and between said second high voltage generator and said anode;

means for applying an AC voltage to said filament including a secondary winding connected to said filament, and a primary winding wound around and spaced from said secondary winding, both said windings being located in and coaxial with said X-ray generator section; and means for cooling said anode.

15. The X-ray apparatus of claim 14 wherein said first and second high voltage generators each comprises:

a high voltage transformer having a primary winding and a secondary winding; and a rectifier interposed between said secondary winding and said high voltage contact means.

16. The X-ray apparatus of claim 14 wherein said first and second high voltage generators are encapsulated in said first and second high voltage generator sections, respectively, with an epoxy resin.

17. The X-ray apparatus of claim 14 wherein said AC voltage applying means is encapsulated in said first high voltage generator section with a resin.

18. The X-ray apparatus of claim 14 wherein said cathode further comprises:

a cylindrical support member for supporting said filament toward an open end of said cylindrical member, said secondary winding of said AC voltage applying means being wound on said support member; and a cylindrical cap mounted on said support member for shielding said filament and for collecting floating electrons from said filament.

19. The X-ray apparatus of claim 18 wherein said support member is made of a non-magnetic material.

20. The X-ray apparatus of claim 14 wherein bushing means comprises:

first and second bushings forming end walls of said X-ray generator section, said first and second bushings having substantially V-shaped longitudinal cross sections and being recessed inwardly; and third and fourth bushings forming end walls of said first and second high voltage generator sections, respectively, said third and fourth bushings having substantially V-shaped longitudinal cross sections and being extending outwardly for insertion into said first and second bushings, respectively, said anode being supported by said second bushing.

21. The X-ray apparatus of claim 20 wherein said cooling means includes a passageway in said second bushing for flowing a coolant for cooling said anode.

22. The X-ray apparatus of claim 20 wherein at least one of said first and third bushings and at least one of said second and fourth bushings are made of a synthetic rubber.

* * * * *

UNITED STATES PATENT AND TRADEMARK OFFICE

CERTIFICATE OF CORRECTION

PATENT NO. : 4,418,421
DATED : Nov. 29, 1983
INVENTOR(S) : Kitadate et al.

It is certified that error appears in the above—identified patent and that said Letters Patent is hereby corrected as shown below:

Col. 5, line 17, change "100" to --100'--.

Col. 5, line 32, delete "a" (second occurrence).

Col. 5, line 38, change "200" to --200'--.

Signed and Sealed this

*Twelfth* Day of *June 1984*

[SEAL]

*Attest:*

GERALD J. MOSSINGHOFF

*Attesting Officer*

*Commissioner of Patents and Trademarks*